US005275046A

United States Patent [19]

Nagpal et al.

[11] Patent Number: 5,275,046

[45] Date of Patent: Jan. 4, 1994

[54] ENTRANCE CONTOUR DESIGN TO STREAMLINE METAL FLOW IN A FORGING DIE

[75] Inventors: Vijay Nagpal, Westland; William J. Fuhrman, Bloomfield Hills; David H. Dodds, South Lyon, all of Mich.

[73] Assignee: Ford Motor Company, Dearborn, Mich.

[21] Appl. No.: 952,425

[22] Filed: Sep. 28, 1992

[51] Int. Cl.[5] ..... B21C 25/02; B21C 25/10

[52] U.S. Cl. ..... 72/467; 72/260; 76/107.1

[58] Field of Search ..... 72/467, 253.1, 260; 76/107.1

[56] References Cited

U.S. PATENT DOCUMENTS

| | | | |
|---|---|---|---|
| 2,764,042 | 9/1956 | Gotze | 72/467 |
| 3,605,475 | 9/1971 | Eakin | 72/260 |
| 3,910,091 | 10/1975 | Samanta | 72/256 |
| 4,622,842 | 11/1986 | Bachrach et al. | 72/467 |
| 5,052,210 | 10/1991 | Hoge | 72/467 |

FOREIGN PATENT DOCUMENTS

| | | | |
|---|---|---|---|
| 1038047 | 8/1983 | U.S.S.R. | 72/467 |

*Primary Examiner*—Daniel C. Crane

*Attorney, Agent, or Firm*—Roger L. May; Joseph W. Malleck

[57] ABSTRACT

A forging die and a forging die manufacturing method for extruding helical gears wherein the lead end face of each die tooth is made up of harmonious S-shaped curves with each curve having maximized-radii contours. The shape of the S-shaped curves is formed by dividing the cylindrical surface at the lead end face and the full depth perimeter into an equal number of equally spaced points, connecting these points up into pairs so as to establish the shortest distance between the pairs of points and using these pairs as the end points for the S-shaped curves.

15 Claims, 3 Drawing Sheets

ENTRANCE CONTOUR DESIGN TO STREAMLINE METAL FLOW IN A FORGING DIE

TECHNICAL FIELD

This invention relates to forging die designs and methods for making the same, particularly cold forging dies for cold extruding helical gears.

BACKGROUND OF INVENTION

As is well known, cold forging various industrial parts is one of several forging techniques available to the artisan. In certain instances, it offers particular advantages over hot forging techniques, for example, because it includes less expensive billet preparation and eliminates post-forging processes such as descaling and the like. On the other hand, cold forging requires substantially higher forging forces to cause the metal to flow through the forging die. This produces significant stresses on the forging die itself and thus creates significant limitations on the process itself, including low die life and premature breakage. This is particularly true when forging helical gears, as opposed to spur gears, since the gear teeth are formed at an angle relative to the vertical axis of the die and this, in turn, produces a reaction force perpendicular to the axis of the forging die teeth which results in significant bending stresses and resultant early die failure. Particularly, this may result in the die teeth shearing at the lead end of the die as a result of substantial bending stresses.

It is known that these bending stresses can be reduced by allowing the die, or die punch, or both, to freely rotate during the forging stroke about the vertical axis of each. This reduces stress on the entire die and consequently on the lead end of the die teeth.

It is also known, as shown in U.S. Pat. No. 5,052,210, assigned to the assignee of the present invention, that the effect of this compressive force may be controlled by providing a compound angle at the lead end face of the die teeth such that one end face land constituting at least a major portion of the land is perpendicular to the helix and the remaining end face land is perpendicular to the die axis.

Beyond the above mentioned teachings, the art of reducing or controlling compressive flows produced by forging, in the production of cold forge gear blanks having internal or external gear teeth through careful gear design, is not well known.

SUMMARY OF THE INVENTION

The present invention includes a gear die design for producing cold forge helical gears, such as commonly used as a planet gear in planetary gear sets, that increases substantially gear die production life by evenly distributing the cold forming stresses throughout the billet-to-tooth transition zone, virtually eliminating die tooth bending in the die land area, and automatically orienting the billet material to the correct helix angle prior to its reaching that portion of the die tooth representing full tooth height.

The invention further includes a gear die design that streamlines the directional flow of the extruded forged material in a manner ensuring the most direct path of material flow thus reducing hot spots of work hardening, imparting the lowest possible bending stresses upon the die teeth, and preserving a more uniform layer of surface lubrication.

The invention further includes a gear die design which materially reduces the forces required to cold extrude a forging through a gear die.

The invention includes further a method for constructing the lead end face of the die gear teeth in such a manner that the extrusion stresses are redistributed in a manner significantly increasing die life.

The method of the invention includes the step of constructing the lead end face of the die teeth to have harmonious S-shaped curves, with each curve having a maximized-radii contour throughout that will evenly distribute the cold forming stresses and virtually eliminate die tooth bending in the die land area, thereby resulting in increased die life.

The invention also includes a method for designing the structure of the die teeth in a manner which will assure accomplishment of the stated objectives.

In brief, the lead end face of the die teeth includes harmonious S-shaped curves determined by dividing the cylindrical surface at the inlet end of the lead end face into a first set of equally spaced points, dividing the full depth perimeter into an equal number of equally spaced points in a second set, connecting each point in the first set to a corresponding point in the second set so as to establish the shortest distance between the points connected up in pairs, using each pair of points as the end points of the harmonious S-shaped curves, and using maximized-radii contours to determine the slope of the S-shaped curves.

The above objects, features and advantages of the present invention, as well as others, are readily apparent from the following detailed description of the best mode for carrying out the invention when taken in connection with the accompanying drawings.

BEST MODE FOR CARRYING OUT THE INVENTION

Figure 1:
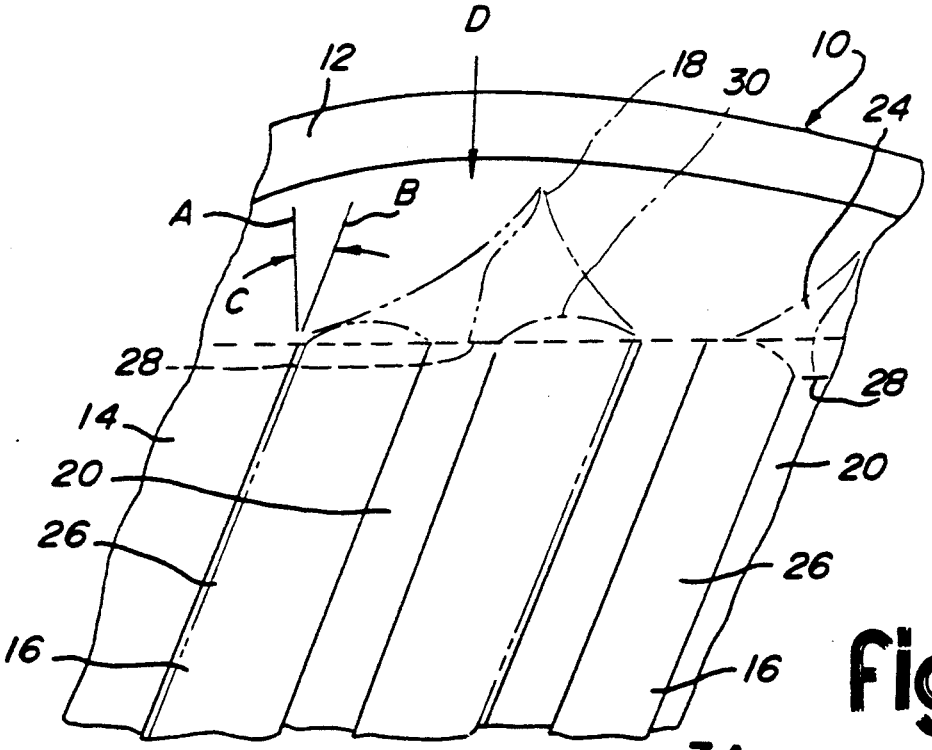
FIG. 1 is a partial view of the interior surface of an extrusion die showing helical die teeth viewed radially outward from the central axis of the die in accordance with the present invention.
Figure 4:
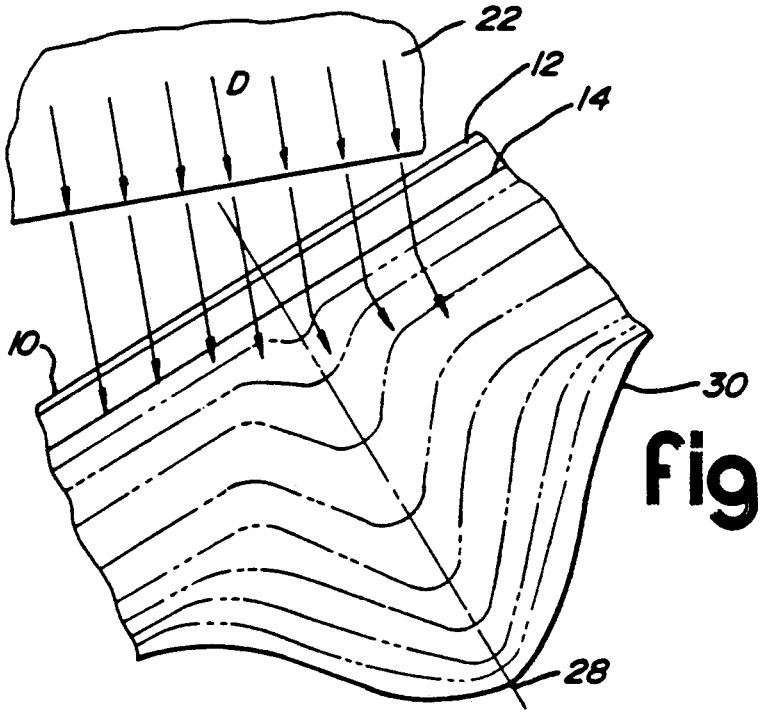
FIG. 4 is a view showing the lead end face of a die tooth taken along line 4—4 of FIG. 3.

Referring to FIGS. 1 and 4 principally, a hollow die generally designated 10 is shown having an upper surface 12 at the inlet end of the die 10 and an internal cylindrical surface 14. The inlet end of the die is the end into which the cylindrical extrusion blank 22 is inserted, as shown in FIG. 4. On the cylindrical surface 14 are equally spaced multiple adjacent helical die teeth 16 extending from the cylindrical surface 14 to the crest 20 of each tooth 16. Each tooth 16 has a die tooth land 26 which is the portion of tooth 16 that extends from the location where full tooth height is first realized on the inlet end of the tooth 16 to the outlet end of the die 10, and also a base 18 which is located on the cylindrical surface 14 at the inlet end of the die teeth 16 and represents the beginning of the lead-in tapered portion of a tooth. Line A, at the base of the tooth, is parallel to the central axis of the die 10; and line B, at the base of the tooth, is parallel to the helix, which is the gear tooth axis. The included angle, defined by the intersection of lines A and B, is the helix angle C. The helix angle C will vary depending upon the gear design, and is commonly 20–22 degrees. The extrusion blank 22 is inserted in the direction from the upper surface 12 of the die 10 and forced downwardly in the direction of vector D, as seen in FIG. 4, which parallels the central axis of the die.

FIG. 1 also shows the lead end face 24 of the die tooth 16 which rises radially from the base of the tooth 18, on the internal cylindrical surface 14 at the inlet end of the die, to the inlet end 28 of crest 20 which is the point at which the die tooth 16 first attains full depth. The curve formed by the intersection of the die teeth 16 and a plane normal to the central axis at the location of the inlet end 28 of crest 20 is the full-depth perimeter surface 30 as shown in both FIGS. 1 and 2.

Figure 2:
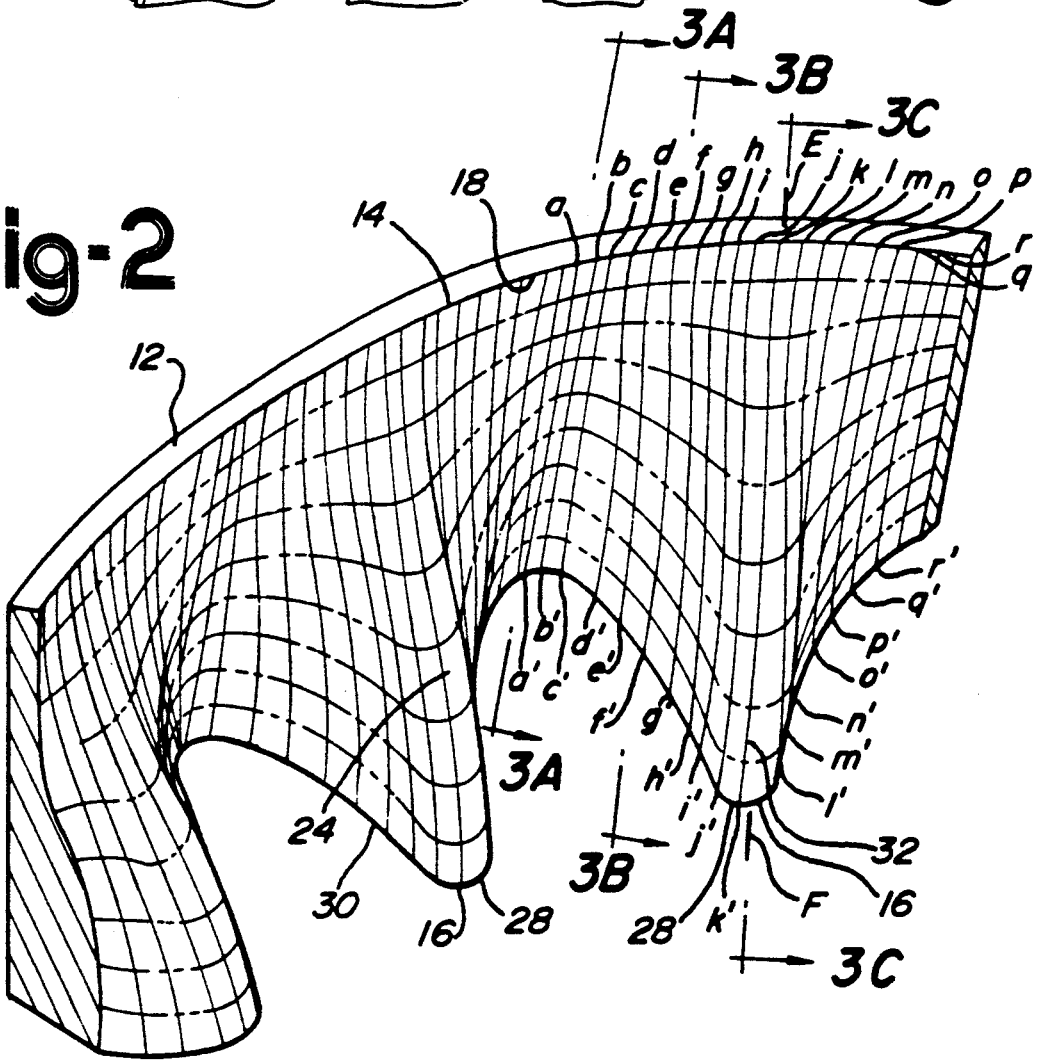
FIG. 2 is a partial view of the interior surface of an extrusion die showing the development of shape of the lead end face of helical die teeth, viewed outwardly from the central axis of the die in accordance with the present invention.
Figure 5:
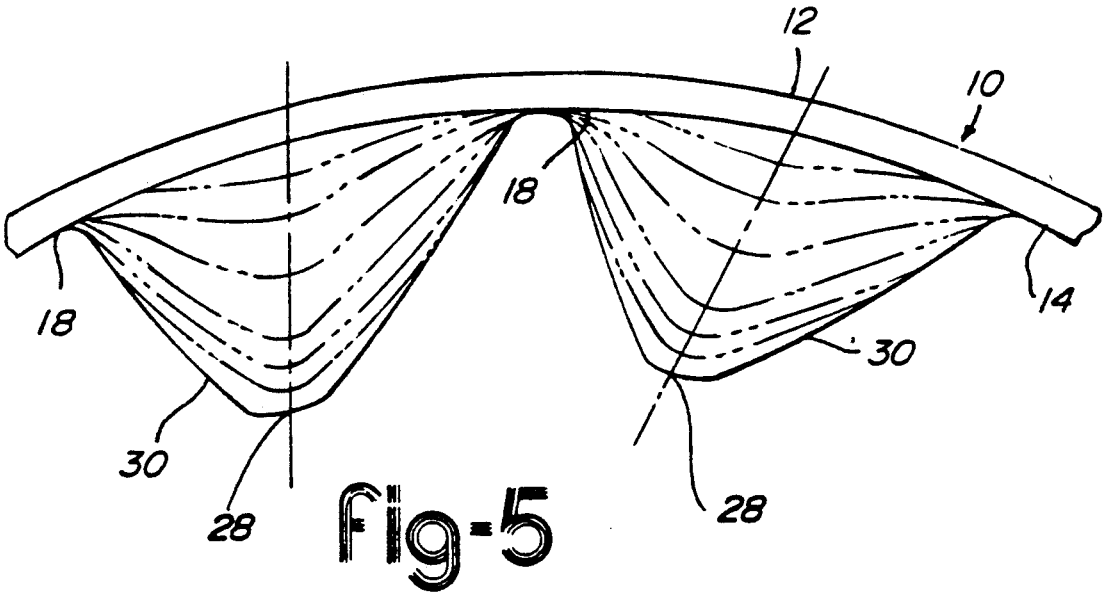
FIG. 5 is a partial view of the interior surface of an extrusion die showing helical die teeth, viewed from the inlet end of the die into the die along the central axis of the die in accordance with the present invention.

Looking at FIGS. 2 and 5, there is shown a representation of the lead end faces 24 of die teeth 16. The lead end faces 24 are made up of harmonious S-shaped curves 32 each beginning at the base 18 and ending at the full depth perimeter 30. The S-shaped curves 32 shown at FIG. 2 at the base 18 are parallel to the central axis of the die 10, as shown by line E, and at the full depth perimeter 30 are parallel to the helix, as shown by line F. The phantom lines in FIGS. 2 and 5 represent contours of the lead end face 24 of each die tooth 16 beginning at the base 18 of the tooth and rising to the full depth perimeter 30, which represents the final die tooth form.

The method of determining the S-shaped curves 32 constitutes an important part of the subject invention and is shown in FIG. 2. The shapes and locations of the harmonious S-shaped curves 32 are determined by (i) dividing the cylindrical surface 14, at the inlet end or base 18 of the lead end face 24 into a first set of equally spaced points, e.g., points a through r; (ii) then dividing the full-depth perimeter 30 into the same number of equally spaced points, i.e., a' through r'; (iii) connecting each point (a, . . . ) in the first set to a corresponding point (a', . . . ) in the second set so as to establish the shortest distance between the points connected up into pairs, i.e., a—a' being a first pair, b—b' being second pair, and so on; and then (iv) using each pair of points (a—a', . . . ) as the end points of a harmonious S-shaped curve 32; and applying a maximized-radii contour in forming each S-shaped curve, thereby establishing a continuously variable optimized slope to the lead-in tapered portion of the die tooth at each point of a series of points radially and axially arranged throughout the entire lead-in portion.

Figure 3A:
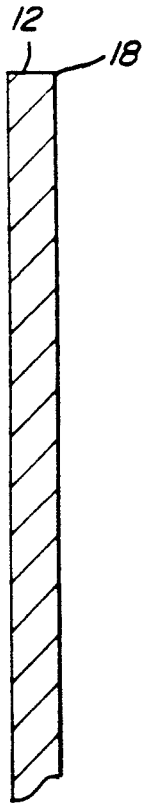
FIGS. 3A–C are cross-sections along the length of a die tooth taken along the lines 3A–3A, 3B–3B and 3C–3C, respectively, of FIG. 2.
Figure 3B:
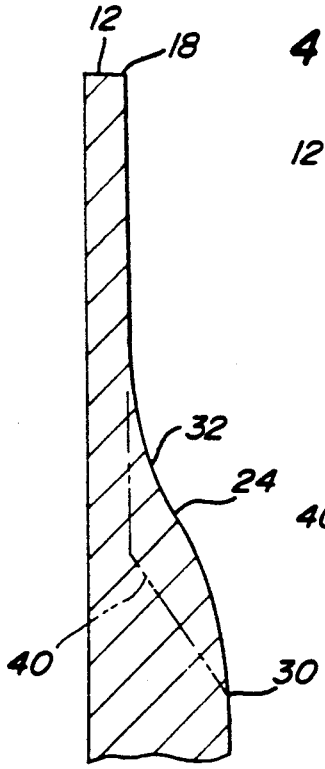
Figure 3C:
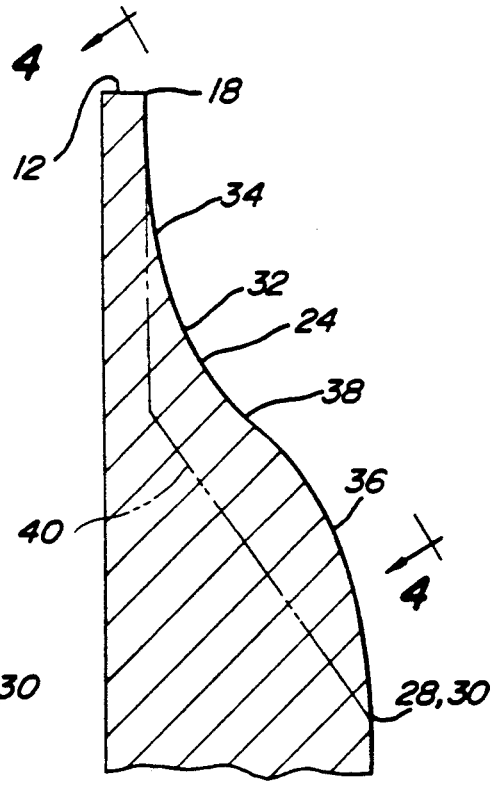

A maximum-radii contour, as used here, is one in which the S-shaped curve 32 has two main components, the first component 34 at the inlet end in which the slope of the S-shaped curve 32 on the cylindrical surface 14 begins at zero (i.e., is parallel to the die central axis) and is increasing radially; and the second component 36 in which the slope decreases radially from the point of maximum slope which is approximately midway axially of the lead-in tapered portion until it becomes tangent to the helix at the full depth perimeter 30, as shown in FIG. 3C. These two components 34, 36 meet at a point of tangency 38 (i.e., the point of maximum slope) along the S-shaped curve 32 when the slope of the S-shaped curve ceases to increase radially and begins to decrease radially. In each of these components 34, 36 the general radius of each curve is maximized within the above parameters. This overall design results in a smooth transition zone from the internal cylindrical surface 14 to the full depth perimeter 30 for each die tooth 16. The method of forming each S-shaped curve, as stated above, is more specifically determined by applying the mathematical equation for a polynomial having zero entrance and exit angles.

Looking at FIGS. 3A–C, there is shown cross sections of a die tooth 16 clearly depicting the S-shaped curves 32. Several factors combine to determine the length of the S-shaped curves 32 for a given gear die design. These factors will be obvious to one skilled in the art given the design parameters and technique described herein. For example, some of these include how fast the particular material of the extrusion blank 22 work hardens, the amount of force needed to push the blank 22 through the die 10, and the full height of a tooth 16. In general, for helix angles ranging from 20–25 degrees, the transition zone, namely the distance from the base 18 to the crest 20 as measured parallel to the die axis and line A, will be from two to three times the tooth height. In the preferred embodiment (i.e., a helical planet gear of SAE4027 steel material having an I. D. of 0.625 inches and an O. D. of 1.270 inches, and sixteen teeth at a tooth height of 0.169 inches), the distance from the base 18 to the inlet end 28 of the crest 20 in a direction parallel to the central axis of the die is 2.37 times the height of the die tooth. The die tooth height is the radial distance from the cylindrical surface 14 to the die tooth crest 20 in a direction normal to the cylindrical surface. As a point of comparison, for standard die design, the crown angle 40 is typically 30°–45° from a plane perpendicular to the die central axis with 30° common, as shown in phantom in FIGS. 3B and 3C.

While the best mode for carrying out the invention has been described in detail, those familiar with the art to which this invention relates will recognize alternative designs and embodiments for practicing the invention, including its application to other gear forms, e.g., spur gears. Thus, the above described preferred embodiment is intended to be illustrative of the scope of the following appended claims.

We claim:

1. A method of making a cylindrical die for extruding gears, the cylindrical die having spaced die teeth extending radially from the cylindrical surface of the die relative to the central axis of the die and extending lengthwise of the die, the die having an inlet end adapted to receive a cylindrical billet of predetermined outer diameter and length and an outlet end from which the billet is expelled following the billet being extruded through the die teeth thereby forming a gear body having circumferentially arranged gear teeth;

the die teeth each having a lead end face nearest the inlet end of the die, a base located on the cylindrical surface at the inlet end of the end face, a crest beginning at the opposite end of the lead end face from the base at the peak of the die tooth where the full die tooth height is first realized and continuing on to the outlet end of the die, and a full depth perimeter established at the intersection of a plane normal to the central axis of the die and the die teeth at the inlet end of the crest of the teeth;

said method comprising the steps of:

forming the lead end face contour of each die tooth to conform to a series of radially spaced harmonious S-shaped curves, each beginning at said base and ending at the full depth perimeter, the S-shaped curves being parallel to the die central axis at the base and parallel to the gear tooth axis at the full depth perimeter; and locating and shaping said harmonious S-shaped curves by (i) dividing the cylindrical surface at the inlet end of the lead end face into a first set of equally spaced points, (ii) dividing the full depth perimeter into an equal number of equally spaced points in a second set, (iii) connecting each point in the first set to a corresponding point in the second set and thereby establishing the shortest distance between the points connected in paris, (iv) using each said pair;

said maximized-radii contour being established by dividing said S-shaped curve into two components;

the first curve component having a slope of zero at said cylindrical surface at the inlet end of the lead end face and said slope increasing radially thereafter to a point of maximum slope located approximately midway of said S-shaped curve;

the second component having a slope of zero at said full depth perimeter and said slope decreasing radially from said point of maximum slope to said full depth perimeter whereupon said S-shaped curve is tangent to the crest of said die teeth.

2. A method of making a cylindrical die for cold extruding helical gears, the cylindrical die having spaced die teeth extending radially inwardly from the cylindrical inner surface of the die toward the central axis of the die and extending lengthwise of the die along a helix angle, the die having an inlet end adapted to receive a cylindrical billet of predetermined outer diameter and length and an outlet end from which the billet is expelled following the billet being extruded through the die teeth thereby forming a gear body having eternally arranged gear teeth;

the die teeth being equally spaced relative to one another about the circumference of the inner cylindrical surface;

the die teeth extending radially inward and each having a lead end face nearest the inlet end of the die, a base located on the inner cylindrical surface at the inlet end of the end face, a crest beginning at the opposite end of the lead end face from the base at the peak of the die tooth where the full die tooth height is first realized and continuing on to the outlet end of the die, and a full depth perimeter defined by the intersection of a plane normal to the central axis of the die and the die teeth at the inlet end of the crests of the teeth;

said method comprising the steps of:

forming the lead end face contour of each die tooth to conform to a series of radially spaced harmonious S-shaped curves beginning at the base and ending at the full depth perimeter, the S-shaped curves being parallel to the die central axis at the base and parallel to the helix at the full depth perimeter; and locating and shaping said harmonious S-shaped curves determined by (i) dividing the inner cylindrical surface at the inlet end of the lead end face into a first set of equally spaced points, (ii) dividing the full depth perimeter into an equal number of equally spaced points in a second set, (iii) connecting each point in the first set to a corresponding point in the second set thereby establishing the shortest distance between the points connected in pairs, (iv) using each pair of points as the end;

said maximized-radii contour being established by dividing said S-shaped curve into two components;

the first curve component having a slope of zero at said cylindrical surface at the inlet end of the lead end face and said slope increasing radially thereafter to a point of maximum slope located approximately midway of said S-shaped curve;

the second component having a slope of zero at said full depth perimeter and said slope decreasing radially from said point of maximum slope to said full depth perimeter whereupon said S-shaped curve is tangent to the crest of said die teeth.

3. The method of claim 2 further comprising providing each die tooth with a helix angle of about 20 degrees to about 25 degrees.

4. The method of claim 3 further comprising establishing the length of the lead end face of each die tooth as measured from the base to the crest of about 2 to about 3 times the die tooth height.

5. A cylindrical die for cold extruding gears, the cylindrical die having spaced die teeth extending radially from the cylindrical surface of the die relative to the central axis of said die and extending lengthwise of the die along a gear tooth axis, the die having an inlet end adapted to receive a cylindrical billet of predetermined outer diameter and length and an outlet end from which the billet is expelled following the billet being extruded through said die teeth thereby forming a gear body having circumferentially arranged gear teeth;

the die teeth each having a lead end face nearest the inlet end of the die, a base located on the cylindrical surface at the inlet end of the end face, a crest beginning at the opposite end of the lead end face from the base at the peak of the die tooth where the full die tooth height is first realized and continuing on to the outlet end of the die, and a full depth perimeter surface which is a curve created by the intersection of a plane normal to the central axis of the die and the die teeth at the inlet end of the crest of the teeth;

the lead end face of each die tooth being contoured to conform to a series of radially spaced harmonious S-shaped curves beginning at the base and ending at the full depth perimeter surface, each S-shaped curve being parallel to the die central axis at the base and parallel to the gear tooth axis at the full depth perimeter surface; and the disposition of each harmonious S-shaped curve being established by (i) dividing the cylindrical surface, at the inlet end of the lead end face, into a first set of equally spaced points, (ii) dividing the full depth perimeter into the same number of equally spaced points in a second set, (iii) connecting each point in the first set to a corresponding point in the second set so as to establish the shortest distance between the points connected up in pairs, (iv) using each pair of points as the end points of a respective one of said harmonious S-shaped curves, and (v) applying a maximized-radii contour at each point along the length of the respective S-shaped curve to thereby provide an optimum balance between degree of metal flow and force on the billet and die to acquire that degree of metal flow[.]

said maximized-radii contour being established by dividing said S-shaped curve into two components;

the first curve component having a slope of zero at said cylindrical surface at the inlet end of the lead end face and said slope increasing radially thereafter to a point of maximum slope located approximately midway of said S-shaped curve;

the second component having a slope of zero at said full depth perimeter and said slope decreasing radially from said point of maximum slope to said full depth perimeter whereupon said S-shaped curve is tangent to the crest of said die teeth.

6. The invention of claim 5 wherein the gear tooth axis is disposed at an angle relative to the central axis of the die to thereby form a helix angle.

7. The invention of claim 6 wherein the helix angel ranges from about 20 degrees to about 25 degrees.

8. The invention of claim 7 wherein the length of the lead end face of each die tooth as measured from the base to the crest, in a direction parallel to the central axis of the die, is about 2 to 3 times the die tooth height.

9. The invention of claim 7 wherein the distance from the base to the crest, in a direction parallel to the central axis of the die, is about 2.37 times the height of the die teeth.

10. The invention of claim 5 wherein said die teeth extend radially inwardly from the cylindrical inner surface of the die toward the central die axis;

the die teeth being equally spaced relative to one another about the circumference of the inner surface of the die.

11. The invention of claim 10 wherein the gear tooth axis is disposed at an angle relative to the central axis of the die to thereby form a helix angle ranging from about 20 degrees to about 25 degrees; and the length of the lead end face of each die tooth as measured from the base to the crest, in a direction parallel to the central die axis, is about 2 to 3 times the die tooth height.

12. The invention of claim 11 wherein the die is especially adapted to cold extrude a helical planet gear of SAE 4027 steel and includes a diameter at the base of about 1.270 inches, a full tooth height of about 0.169 inches and about sixteen teeth.

13. The method of claim 1 wherein said S-shaped curve is determined by applying the mathematical equation for a polynomial having zero entrance and exit angles.

14. The method of claim 4 wherein said S-shaped curve is determined by applying the mathematical equation for a polynomial having zero entrance and exit angles.

15. The invention of claim 5 wherein said S-shaped curve is determined by applying the mathematical equation for a polynomial having zero entrance and exit angles.

* * * * *